US008454087B2

(12) United States Patent
Canterbury

(10) Patent No.: US 8,454,087 B2
(45) **Date of Patent: *Jun. 4, 2013**

(54) CHAIR INTERCONNECTION FOR A GAMING MACHINE

(75) Inventor: Stephen A. Canterbury, Antioch, IL (US)

(73) Assignee: WMS Gaming Inc., Waukegan, IL (US)

( * ) Notice: Subject to any disclaimer, the term of this patent is extended or adjusted under 35 U.S.C. 154(b) by 244 days.

This patent is subject to a terminal disclaimer.

(21) Appl. No.: 11/569,687

(22) PCT Filed: May 26, 2005

(86) PCT No.: PCT/US2005/018475

§ 371 (c)(1),
(2), (4) Date: Jan. 28, 2008

(87) PCT Pub. No.: WO2005/117648

PCT Pub. Date: Dec. 15, 2005

(65) Prior Publication Data

US 2008/0246321 A1 Oct. 9, 2008

Related U.S. Application Data

(60) Provisional application No. 60/575,605, filed on May 28, 2004, provisional application No. 60/575,604, filed on May 28, 2004, provisional application No. 60/575,153, filed on May 28, 2004, provisional application No. 60/640,350, filed on Dec. 30, 2004.

(51) Int. Cl.
*A47C 31/00* (2006.01)

(52) U.S. Cl.
USPC ..... 297/217.4; 297/217.3; 381/119; 439/489

(58) Field of Classification Search
USPC ..... 297/217.1, 217.3, 217.4; 381/119
See application file for complete search history.

(56) References Cited

U.S. PATENT DOCUMENTS

| | | | | |
|---|---|---|---|---|
| 2,689,016 | A | | 9/1954 | Lang |
| 4,413,198 | A | | 11/1983 | Bost |
| 4,549,631 | A | | 10/1985 | Bose |
| 4,660,833 | A | * | 4/1987 | Dickinson et al. ..... 463/20 |
| 4,664,456 | A | | 5/1987 | Blair et al. |
| 4,705,274 | A | | 11/1987 | Lubeck |
| 4,805,952 | A | | 2/1989 | Coleman |
| 4,840,343 | A | | 6/1989 | Gasser |

(Continued)

FOREIGN PATENT DOCUMENTS

| | | |
|---|---|---|
| JP | JP5031254 | 2/1993 |
| WO | WO-2005120127 A1 | 12/2005 |

OTHER PUBLICATIONS

"International Search Report for Application No. PCT/US2005/018475, date mailed Oct. 21, 2005", 5 pgs.

(Continued)

*Primary Examiner* — David Dunn
*Assistant Examiner* — David E Allred
(74) *Attorney, Agent, or Firm* — Schwegman Lundberg & Woessner, P.A.

(57) ABSTRACT

A gaming system includes a chair having an electrical connector and a gaming machine having an electrical connector, wherein the chair electrical connector is removably couplable to the gaming machine electrical connector.

32 Claims, 4 Drawing Sheets

U.S. PATENT DOCUMENTS 4,875,546 A 10/1989 Krnan
4,887,298 A * 12/1989 Haigler ..... 381/55
5,083,738 A 1/1992 Infanti
5,102,192 A 4/1992 Barile
5,114,112 A 5/1992 Infanti
5,232,191 A 8/1993 Infanti
5,290,034 A 3/1994 Hineman
5,344,331 A 9/1994 Hoffman et al.
5,398,992 A 3/1995 Daniels
5,409,296 A 4/1995 Barile
5,437,453 A 8/1995 Hineman
5,522,641 A 6/1996 Infanti
5,542,748 A 8/1996 Barile
5,596,647 A 1/1997 Wakai et al.
5,617,331 A 4/1997 Wakai et al.
5,618,178 A 4/1997 Copperman et al.
5,622,511 A 4/1997 Jarrett
5,669,818 A 9/1997 Thorner et al.
5,678,886 A 10/1997 Infanti
5,762,617 A 6/1998 Infanti
5,768,724 A 6/1998 Buell
5,791,731 A 8/1998 Infanti
5,807,177 A 9/1998 Takemoto et al.
5,908,354 A * 6/1999 Okuniewicz ..... 463/35
5,910,991 A 6/1999 Farrar et al.
5,953,429 A 9/1999 Wakai et al.
6,012,755 A 1/2000 Hecht et al.
6,075,868 A 6/2000 Goldfarb et al.
6,089,663 A 7/2000 Hill
6,135,562 A 10/2000 Infanti
6,161,892 A 12/2000 Chabanne et al.
6,191,892 B1 2/2001 Isaka et al.
6,206,335 B1 3/2001 Huber et al.
6,227,614 B1 5/2001 Rubin
6,290,536 B1 9/2001 Hwang et al.
6,314,330 B1 * 11/2001 Matthews ..... 700/94
6,354,660 B1 3/2002 Friedrich
6,422,670 B1 7/2002 Hedrick et al.
6,422,941 B1 7/2002 Thorner et al.
6,430,297 B1 8/2002 Nakamura
6,443,839 B2 9/2002 Stockdale et al.
6,503,147 B1 1/2003 Stockdale et al.
6,530,842 B1 3/2003 Wells et al.
6,544,200 B1 * 4/2003 Smith et al. ..... 600/595
6,572,187 B2 6/2003 Laufer
6,694,034 B2 2/2004 Julstrom et al.
6,752,445 B1 6/2004 Koehler et al.
6,824,419 B1 11/2004 Wu
6,885,899 B1 4/2005 Yoon
6,899,627 B2 5/2005 Lam et al.
6,928,329 B1 8/2005 Giaimo et al.
6,935,959 B2 8/2005 Danieli et al.
7,090,582 B2 8/2006 Danieli et al.
7,112,139 B2 9/2006 Paz et al.
7,114,171 B2 9/2006 Brady, Jr. et al.
7,136,498 B1 11/2006 Schott
7,206,426 B1 4/2007 Julstrom et al.
7,240,093 B1 7/2007 Danieli et al.
7,290,072 B2 10/2007 Quraishi et al.
7,364,508 B2 4/2008 Loose et al.
7,367,886 B2 5/2008 Loose et al.
7,389,153 B2 6/2008 Giaimo et al.
7,479,063 B2 1/2009 Pryzby et al.
7,522,740 B2 4/2009 Julstrom et al.
7,658,445 B2 * 2/2010 Mittler et al. ..... 297/217.3
7,688,992 B2 3/2010 Aylward et al.
7,704,147 B2 4/2010 Quraishi et al.
7,766,747 B2 8/2010 Bonney et al.
7,819,750 B2 10/2010 Lam et al.
7,826,627 B2 11/2010 Radek
7,832,799 B2 * 11/2010 Davis et al. ..... 297/217.7
7,867,085 B2 1/2011 Pryzby et al.
8,000,484 B2 8/2011 Rasmussen
8,029,369 B2 10/2011 Hahn
8,262,478 B2 9/2012 Pryzby
2002/0041069 A1 4/2002 Steelman
2002/0155887 A1 10/2002 Criss-Puszkiewiez et al.
2003/0044033 A1 3/2003 Julstrom et al.
2003/0054880 A1 3/2003 Lam et al.
2003/0100359 A1 5/2003 Loose et al.
2003/1012297 7/2003 Huang
2003/0152243 A1 8/2003 Julstrom et al.
2003/0185400 A1 * 10/2003 Yoshizawa et al. ..... 381/58
2003/0217363 A1 11/2003 Brady, Jr. et al.
2004/0142747 A1 7/2004 Pryzby
2004/0161115 A1 8/2004 Loose
2004/0162144 A1 8/2004 Loose et al.
2004/0254006 A1 12/2004 Lam et al.
2004/0254020 A1 12/2004 Dragusin
2004/0258270 A1 12/2004 Shima
2005/0053252 A1 3/2005 Cohen
2005/0054442 A1 3/2005 Anderson et al.
2005/0159219 A1 7/2005 Oswald
2005/0164788 A1 * 7/2005 Grabiec ..... 463/35
2005/0239434 A1 10/2005 Marlowe
2006/0064187 A1 * 3/2006 Nishikori et al. ..... 700/94
2006/0068908 A1 3/2006 Pryzby et al.
2006/0068909 A1 3/2006 Pryzby et al.
2006/0072765 A1 * 4/2006 Shibutani ..... 381/59
2006/0073881 A1 4/2006 Pryzby et al.
2006/0100015 A1 5/2006 Loose et al.
2006/0116073 A1 6/2006 Richenstein et al.
2006/0269088 A1 11/2006 Julstrom et al.
2007/0015570 A1 1/2007 Pryzby
2007/0270216 A1 11/2007 Pryzby
2007/0293304 A1 12/2007 Loose et al.
2008/0009347 A1 1/2008 Radek
2008/0039215 A1 2/2008 Hahn
2008/0054561 A1 3/2008 Canterbury et al.
2008/0064486 A1 3/2008 Pryzby et al.
2008/0070685 A1 3/2008 Pryzby et al.
2008/0096666 A1 4/2008 Pryzby et al.
2008/0111408 A1 5/2008 Duran et al.
2008/0139284 A1 6/2008 Pryzby et al.
2008/0161108 A1 7/2008 Dahl et al.
2008/0176654 A1 7/2008 Loose et al.
2008/0188291 A1 8/2008 Bonney et al.
2008/0194319 A1 8/2008 Pryzby et al.
2008/0211276 A1 9/2008 Rasmussen
2008/0214289 A1 9/2008 Pryzby et al.
2008/0234026 A1 9/2008 Radek
2008/0299819 A1 * 12/2008 Kakutani ..... 439/489
2009/0041257 A1 * 2/2009 Yoshizawa et al. ..... 381/59
2009/0170597 A1 7/2009 Bone
2009/0298579 A1 12/2009 Radek et al.
2010/0029385 A1 2/2010 Garvey et al.
2010/0075750 A1 3/2010 Bleich et al.
2010/0099487 A1 * 4/2010 Canterbury et al. ..... 463/25
2010/0248815 A1 9/2010 Radek
2010/0298051 A1 11/2010 Loose et al.
2010/0317437 A1 12/2010 Berry et al.
2012/0258791 A1 10/2012 Pryzby

OTHER PUBLICATIONS

"Written Opinion of the International Searching Authority for Application No. PCT/US2005/018475, date mailed Oct. 21, 2005", 9 pgs.
"U.S. Appl. No. 11/569,689, Amendment and Response filed Aug. 16, 2010 to Final Office Action mailed Sep. 14, 2009", 22 pgs.
"U.S. Appl. No. 11/569,730, Response filed Jan. 13, 2011 to Non Final Office Action mailed Oct. 13, 2010", 14 pgs.
"International Application Serial No. PCT/US05/18595, International Search Report mailed Oct. 25, 2005", 2 pgs.
"International Application Serial No. PCT/US05/18595, Written Opinion mailed Oct. 25, 2005", 6 pgs.
"International Application Serial No. PCT/US05/18681, International Search Report mailed Oct. 24, 2005", 3 pgs.
"International Application Serial No. PCT/US05/18681, Written Opinion mailed Oct. 24, 2005", 5 pgs.
"U.S. Appl. No. 11/569,730, Non-Final Office Action mailed Oct. 13, 2010", 14 pgs.
"U.S. Appl. No. 11/569,732 Non-Final Office Action mailed Sep. 10, 2010", 12 pgs.
"U.S. Appl. No. 11/569,732, Examiner Interview Summary Request Sep. 24, 2009", 2 pgs.

"U.S. Appl. No. 11/569,732, Preliminary Amendment filed Nov. 28, 2006", 3 pgs.
"U.S. Appl. No. 11/569,732, Response filed Aug. 16, 2010 to Final Office Action mailed Apr. 16, 2010", 19 pgs.
"U.S. Appl. No. 11/569,732, Response filed Jan. 29, 2010 to Restriction Requirement mailed Dec. 29, 2009", 7 pgs.
"U.S. Appl. No. 11/569,732, Response filed Dec. 10, 2010", 19 pgs.
"U.S. Appl. No. PCT/US05/18475, International Search Report mailed Oct. 21, 2005", 4 pgs.
"U.S. Appl. No. PCT/US05/18475, Written Opinion mailed Oct. 21, 2005", 6 pgs.
"U.S. Appl. No. 11/569,689, Non Final Office Action mailed May 31, 2011", 26 pgs.
"U.S. Appl. No. 11/569,730, Final Office Action mailed Apr. 4, 2011", 7 pgs.
"U.S. Appl. No. 11/569,732, Final Office Action mailed Mar. 4, 2011", 14 pgs.
"U.S. Appl. No. 11/569,732, Notice of Allowance mailed Mar. 30, 2011", 10 pgs.
"U.S. Appl. No. 11/569,689, Notice of Allowance maiied Jun. 27, 2011", 12 pgs.
"U.S. Appl. No. 11/569,730, Response flied Jun. 30, 2011 to Final Office Action mailed Apr. 4, 2011", 15 pgs.
"U.S. Appl. No. 11/569,730, Advisory Action mailed Aug. 4, 2011", 3 pgs.
"U.S. Appl. No. 11/569,730, Examiner Interview Summary mailed Jun. 22, 2011", 4 pgs.
"U.S. Appl. No. 11/569,730, Examiner Interview Summary Received Jun. 8, 2011", 4 pgs.
"U.S. Appl. No. 11/569,730, Preliminary Amendment filed Nov. 28, 2006", 8 pgs.
"U.S. Appl. No. 11/569,730, Supplemental Amendment and Response filed Aug. 4, 2011 to Advisory Action maked Aug. 4, 2011", 11 pgs.
"U.S. Appl. No. 11/569,689, Applicant's Summary of Examiner Interview filed Aug. 22, 2011", 2 pgs.
"U.S. Appl. No. 11/569,689, Examiner Interview Summary mailed Jul. 22, 2011", 3 pgs.
"U.S. Appl. No. 11/569,730, Non Final Office Action mailed Oct. 13, 2011", 17 pgs.
"U.S. Appl. No. 11/569,730, Examiner Interview Summary Mailed Jan. 23, 2012", 3 pgs.
"U.S. Appl. No. 11/569,730, Response filed Feb. 10, 2012 to Non Final Office Action mailed Oct. 13, 2011", 15 pgs.
"U.S. Appl. No. 11/569,689, Final Office Action mailed Sep. 14, 2009", 18 pgs.
"U.S. Appl. No. 11/569,689, Non-Final Office Action mailed Jan. 13, 2009", 16 pgs.
"U.S. Appl. No. 11/569,689, Preliminary Amendment filed Nov. 28, 2006", 3 pgs.
"U.S. Appl. No. 11/569,689, Response filed Jul. 10, 2009 to Non Final Office Action mailed Jan. 13, 2009", 11 pgs.
"U.S. Appl. No. 11/569,732, Final Office Action mailed Apr. 16, 2010", 12 pgs.
"U.S. Appl. No. 11/569,732, Non-Final Office Action mailed Mar. 18, 2009", 16 pgs.
"U.S. Appl. No. 11/569,732, Response filed Sep. 17, 2009 to Non Final Office Action mailed Mar. 18, 2009", 13 pgs.
"U.S. Appl. No. 11/569,732, Restriction Requirement mailed Dec. 29, 2009", 6 pgs.
"U.S. Appl. No. 11/569,730, Notice of Allowance mailed May 9, 2012", 11 pgs.

* cited by examiner

CHAIR INTERCONNECTION FOR A GAMING MACHINE

CROSS-REFERENCE TO RELATED APPLICATION

This application is a U.S. National Stage Filing under 35 U.S.C. 371 from International Patent Application Serial No. PCT/US2005/018475, filed May 26, 2005, and published on Dec. 15, 2005 as WO 2005/117648 A1,which claims the benefit under 35 U.S.C. 119 (e) of U.S. Provisional Application No. 60/575,605 filed on May 28, 2004, which applications are hereby incorporated by reference in their entirety. This application is related to U.S. Provisional Patent Application Ser. No. 60/575,604, entitled "SPEAKER SYSTEM FOR A GAMING MACHINE" and is also related to U.S. Provisional Patent Application Ser. No. 60/575,153, entitled "GAMING DEVICE WITH ATTACHED AUDIO-CAPABLE CHAIR", both filed on May 28, 2004, and is also related to U.S. Provisional Patent Application Ser. No. 60/640,350, entitled "CHAIR INTERCONNECTION FOR A GAMING MACHINE", filed Dec. 30, 2004, all of which are hereby incorporated by reference herein for all purposes.

FIELD

The invention relates generally to gaming systems, and more specifically to chair interconnections for gaming systems.

COPYRIGHT

A portion of the disclosure of this patent document may contain material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2005, WMS Gaming, Inc. All Rights Reserved.

BACKGROUND

A wide variety of gaming devices are now available to game players and to gaming establishment operators in computerized form, from slot machines to games that are traditionally played live such as poker and blackjack. Computerized video game systems must provide sufficient feedback to the gamer to make the game fun to play, and they must provide a gaming experience that is at least as attractive as the older mechanical gaming machine experience to the gamer, to ensure success in a competitive gaming market.

Many computer elements have been employed in gaming systems, from computerized animation to playing prerecorded sounds through a gaming system's speakers. For example, these sounds are loaded within the computerized gaming machine and played through speakers to supplement the wagering game experience, much as is done with personal computer games and television-based video games.

SUMMARY

In one aspect a gaming system includes a chair having an electrical connector and a gaming machine having an electrical connector, wherein the chair electrical connector is removably couplable to the gaming machine electrical connector.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined or that other embodiments may be utilized and that structural changes may be made without departing from the spirit and scope of the invention. The following detailed description is, therefore, not to be taken in a limiting sense, and the scope of the invention is defined by the appended claims and their equivalents.

As used herein, the term "gaming machine" refers to a machine into which a coin or token is deposited, or which is activated by a card or token associated with data regarding non-monetary chattel, to play a game that uses a video display or an electromechanical device with a spinning reel. The gaming machines include slot machines and push button machines. The gaming machines include coin operated machines and machines having a serial interface.

Gaming machines also include gaming tables capable of being initiated by a card or token.

Figure 1:
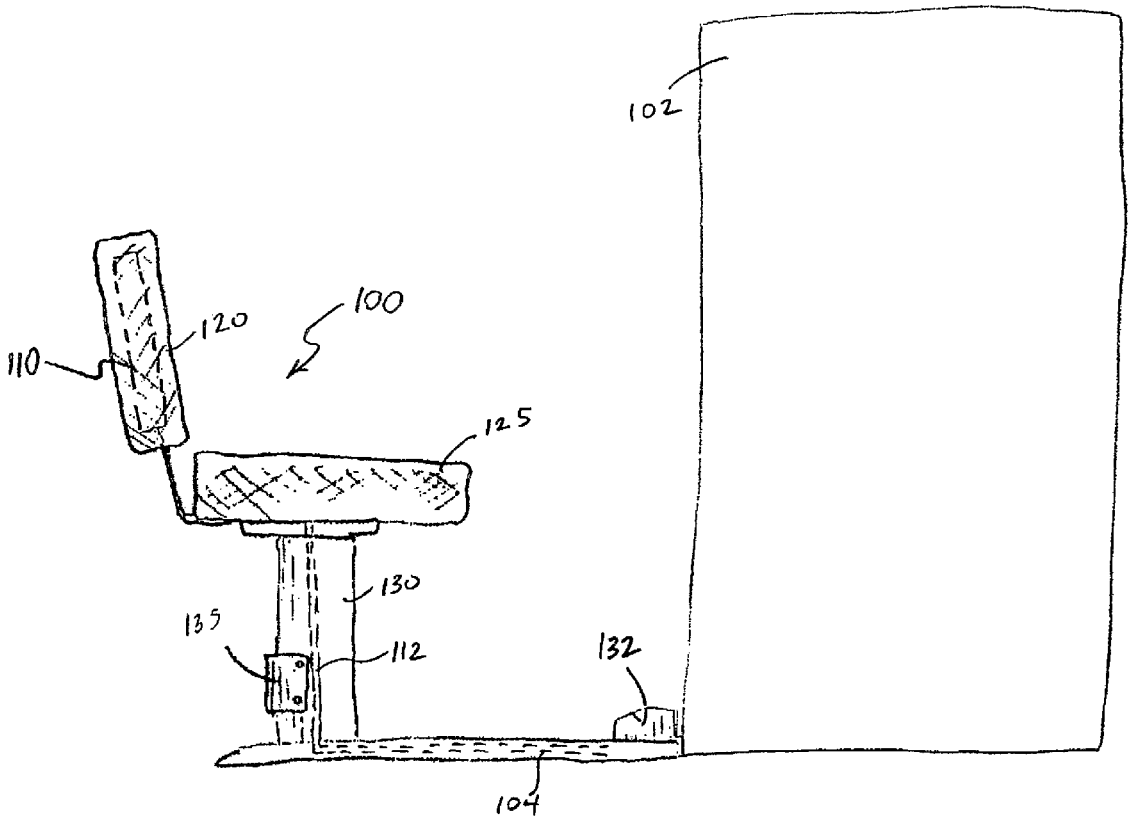
FIG. 1 shows the general environment for a gaming system according to one embodiment.

FIG. 1 shows the general environment for a gaming sound system according to one embodiment. In this example, the system includes chair 100 electrically and mechanically coupled to a gaming device 102. Gaming device 102 can be a gaming machine such as a slot machine, for example. In one embodiment, chair 100 is coupled to the gaming machine via a sled or base 104.

In one embodiment, the system further includes a speaker package 110 incorporated into chair 100 and coupled via an electrical connection to gaming device 102. Gaming device 102 includes hardware and software and produces sound signals which are delivered to speaker package 110. Speaker package 110 provides sound effects, game noises, and other audio effects from gaming device 102. In one example, an electrical connection 112 runs through base 104 from machine 102 to speaker package 110 in the chair.

Chair 100 generally includes a back 120 and a seat 125. The chair is swivel mounted to a seat post 130. Seat post 130 is at least partially hollow to allow connection 112 to run through the post. An access panel 135 can be provided in the seat post 130 to allow access to connection 112 to allow a user to connect wires running from speaker package 110 to a connection in base 104. Base 104 is removably connectable to gaming device 102, both mechanically and electrically. This allows for easier installation and maintenance than a permanent connection.

Figure 2:
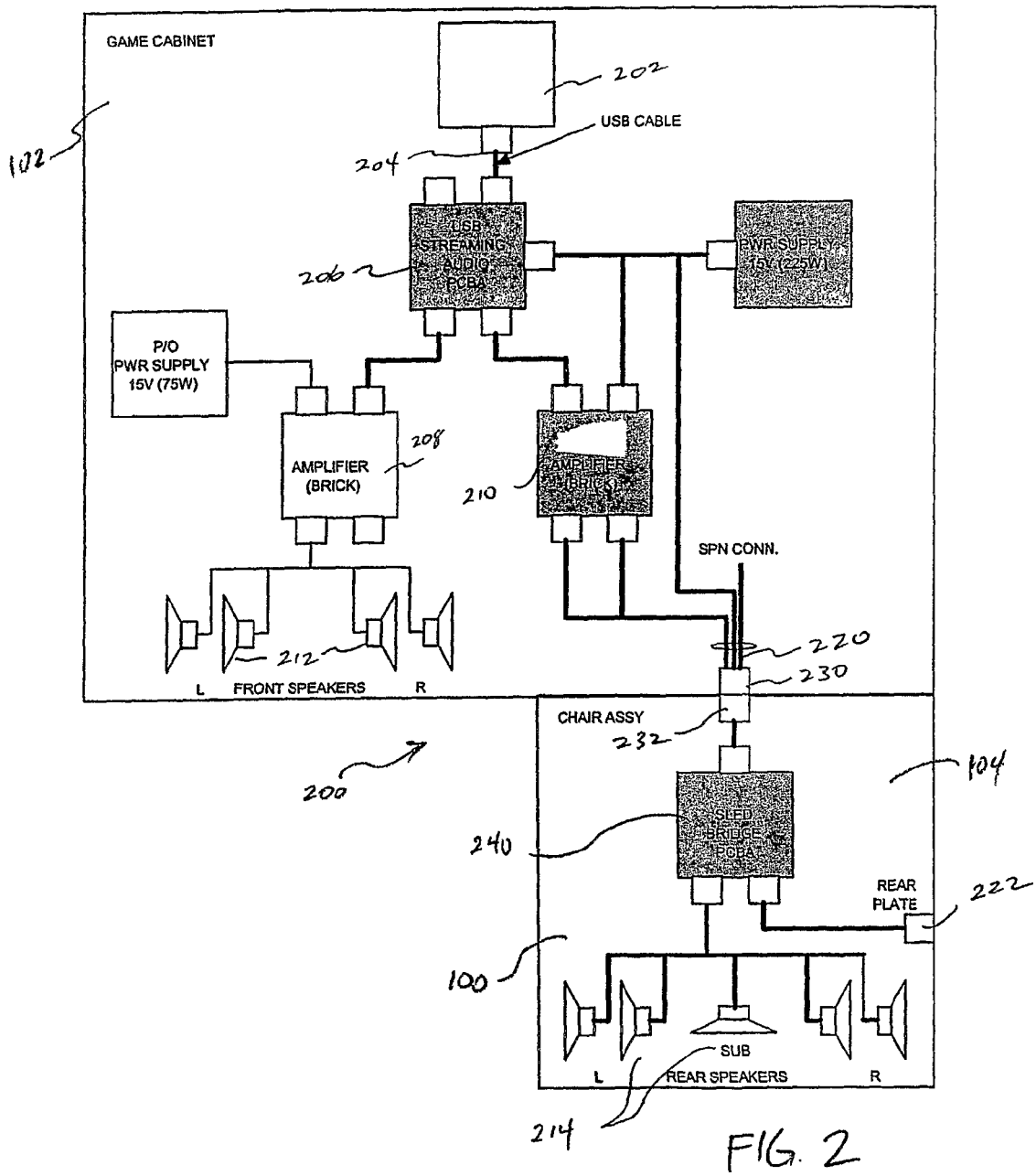
FIG. 2 shows a schematic representation of components of an audio subsystem, in accordance with one embodiment.

FIG. 2 shows a schematic representation of components of an audio subsystem 200, in accordance with one embodiment. For example, audio data resides on CompactFlash media used for holding the game code and inserted into a receptacle for the media located on a circuit board 202. The game software running on circuit board 202 is responsible for determining when to play certain sounds and for the mixing of the sounds. The mixed digital audio is then output via a USB port 204 located on the circuit board. The audio data transmitted over the USB bus consists of four discrete audio channels (2 stereo channels). A USB streaming audio circuit board 206 receives the audio data and splits it into two separate stereo outputs (the outputs can be line level or digital (S/PDIF). These outputs are routed to two audio amplifier modules 208 and 210, —amplifier 208 is for front speakers 212 (speakers located in machine 102) and amplifier 210 is for rear speakers 214 (speakers located in chair 100).

The amplified audio to chair 100 is taken from two separate connectors—one connector provides for the audio for the left and right speakers and one provides the audio for a subwoofer, for example. These outputs are bundled in a cable 220 along with SPN serial communications and power. The serial communications and power are provided to the chair for components such as a display 222. Display can be a lit sign, a video display, or other component that could be located on the back of the chair. These connections go to a connector 230 fixed to the cabinet of game device 102 which mates with a connector 232 on base 104 of the chair. The corresponding connector 232 on base 104 includes a short wire harness connected to the connector that plugs into a connector on a base connection 240 that runs almost the entire length of the chair base 104, ending below the chair post. Base connection 240 can be a circuit board or a flex cable, for example.

In one embodiment, the system monitors the attachment of base 104 to machine 102. For example, an extra port pin on a streaming USB microcontroller on circuit board 206 can communicate via an extra ground wire taken to the connector 230 that the base connector 232 attaches to. The wire can be looped back on the base to a different pin on connector 230. That signal is returned to the USB Streaming Audio circuit board 206 and a pull-up resistor is tied to the signal and the signal is fed to the extra port pin on the microcontroller. The microcontroller samples the input—if it is high then the base is detached, if it is low then the base is attached (ground is connected through the loop). The game CPU then queries the USB Streaming Audio circuit board 206 via USB commands for the status of the base. If the game CPU detects that the base is missing, a tilt condition may occur (safety of the player may be at stake for a chair that is not attached properly) and/or the CPU can elect to mix the audio in a different manner to compensate for the missing chair audio. In other embodiments, there are other ways to detect a missing base, for example, replace the ground wire with an active signal that is looped back, etc. Accordingly, gaming machine 102 can detect that the chair is missing or not connected properly and can act accordingly.

Figure 3:
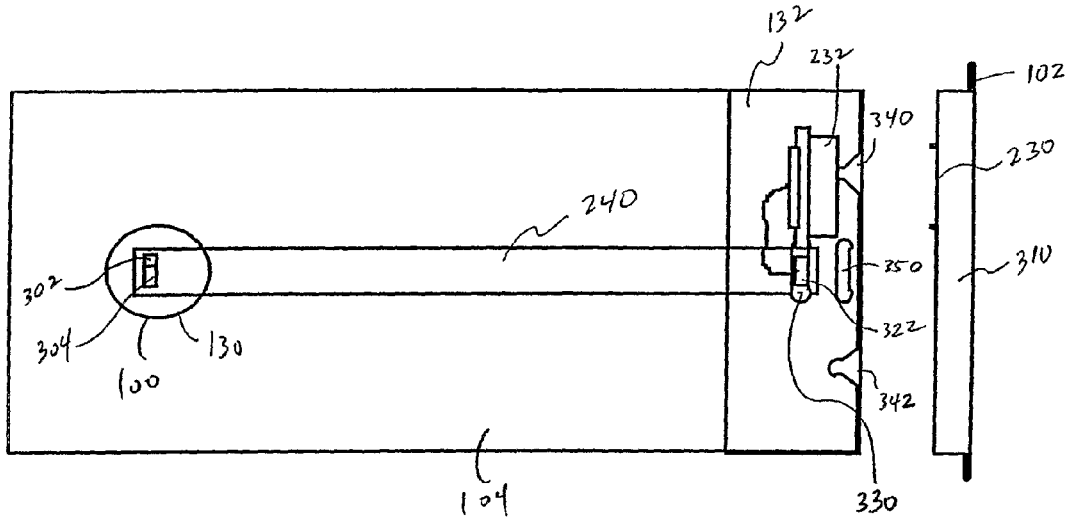
FIG. 3 shows a top view of a chair and gaming machine interconnection, in accordance with one embodiment.
Figure 4:
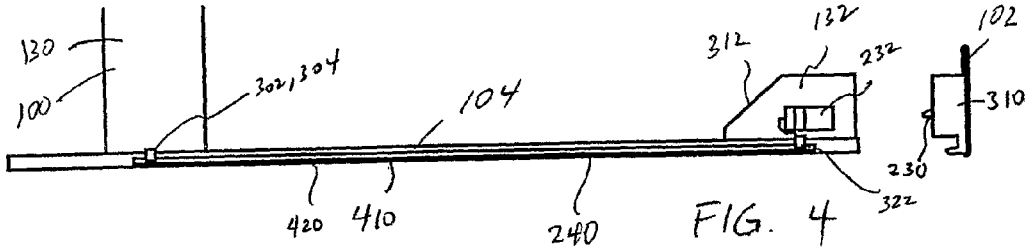
FIG. 4 is a side view of FIG. 3.

FIG. 3 shows a top view of the interconnection between chair 100 and gaming machine 102, in accordance with one embodiment, and FIG. 4 is a side view of FIG. 3. In one embodiment, two connectors 302, 304 are located under chair post 130 and allow for an electrical connection, such as a cable harness, to be plugged into the board for the speakers and a separate harness for the SPN and power connections. These cable harnesses will be routed up through chair post 130 to the devices they attach to in the chair.

In one embodiment, connector 232 on base 104 is a receptacle side of a blind-mate drawer connector. One embodiment uses Tyco Electronics AMP 213974-1, for example. Connector 232 can be fixed to base 104 with the connector mating occurring when the base 104 is latched into a retention assembly 310, or connector 232 could be fixed to protective cover or shroud 132 with the cover 132 being able to move to mate connectors 232 and 230 as a secondary operation to the latching of the base to the machine 102. If the connection is made when the base is attached to the cabinet, then alignment between the base 104 and retention assembly 310 is configured to ensure that the base, and thus the connectors, are aligned in the horizontal and vertical direction prior to the connector housings coming into contact with each other.

Cover 132 for connectors 232, 230 helps to keep the connections from being exposed to tampering by patrons or drink spills. In one example, cover 132 is shaped as a foot rest including a sloping surface 312. If cover 132 moves to mate the connectors 232 and 230, then base 104 is not allowed to be unlatched unless the connectors are unlatched at the same time or prior to the base being unlatched. In other embodiments, the connector 232 can be buried into base 240 and cover 132 is omitted.

The connection from the receptacle side of connector 232 to a connector 322 on base connection 240 is also shown. In one embodiment, base connection 240 is placed in a channel 410 routed out underneath base 104 with an access hole 330 in base 104 for the connector 322 on the base connection 240 that mates with the drawer connector 232. In one example, connector 322 is a 16 contact Molex Micro-Fit Surface-Mount connector (part number 43045-18xx). In one example, base connector 240 can include a circuit board having a thickness of about 0.062"+/−0.007". As noted above, other embodiments utilize a flex cable as the base connection. An insulator can be sandwiched between the base connector 240 and the base. A retention plate 420 can be used to hold the base connector 240 and insulator in place.

The other end of base connector 240 includes two connectors 302, 304. These facilitate cables that are dropped from the chair through the chair post 130 prior to being connected. In one embodiment, both of these connectors can also be Molex Micro-Fit Surface-Mount connectors. A 10-contact connector (part number 43045-10xx) can be used for connection to up to five speakers within the chair, for example. A 6-contact connector (part number 43045-06xx) can be used to connect auxiliary functions in the chair, for example.

Figure 5:
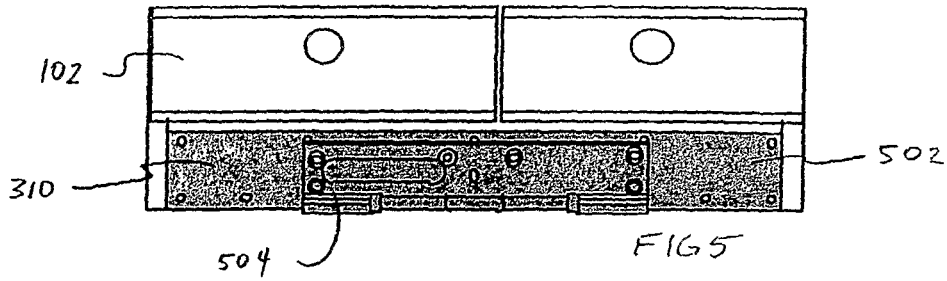
FIG. 5 shows a front view of a retention assembly, in accordance with one embodiment.

FIG. 5 shows a retention assembly 310, in accordance with one embodiment. Retention assembly 310 is mounted to game device 102 and is for electrically and mechanically mounting the chair base to the game device. Retention assembly 310 is mounted to the machine 102 so as to fit over an opening at the base of the front of the game cabinet 102. This opening is used to facilitate the routing of wires to the chair. Retention assembly 310 includes a plate 502 that runs across the width of the bottom of the cabinet 102 to provide rigidity. A latching mechanism 504 is mounted to plate 502 prior to the entire assembly 310 being mounted to cabinet 102.

Figure 6:
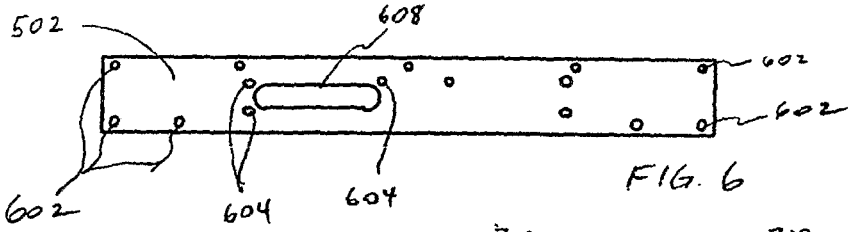
FIG. 6 shows a front view of mounting plate, in accordance with one embodiment.

FIG. 6 shows a front view of mounting plate 502, in accordance with one embodiment. The back plate 502 includes holes 602 for mounting the plate to the cabinet, holes 604 for mounting the latching mechanism 504, and a single larger opening 608 for the rear of connector 230 (FIG. 3) along with its attached wires to protrude through.

Figure 7:
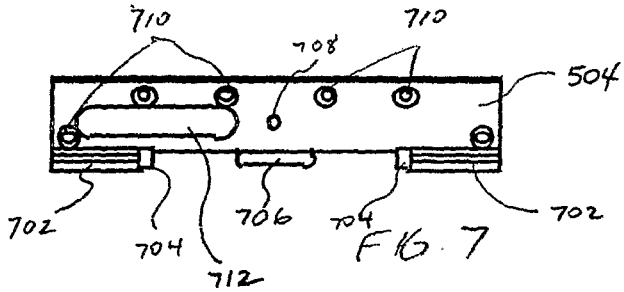
FIG. 7 shows a front view of a latching mechanism according to one embodiment.

FIG. 7 shows a front view of latching mechanism 504 according to one embodiment. Latching mechanism 504 includes feet 702 that keep the mating chair base aligned in the up-down direction as the chair base is being pushed into the latching mechanism. In one embodiment, latching mechanism 504 includes one or more alignment pins 704 that keep the mating base aligned in the X and Y directions. For example, the base can include corresponding socket or grooves 340, 342 (FIG. 3) that mate with pins 704. A spring-loaded door latch 706 locks the base in place by latching onto a cavity or hole 350 on the base (FIG. 3). A hole 708 allows a tool to be inserted to release the door latch 706 and thus unlock the mated base. Holes 710 are used for mounting the latching mechanism to plate 502. An opening or cavity 712 allows the floating end of blind-mate connector 230 to be installed in the bracket. This cavity aligns to opening 608 in plate 502 to allow the wires to exit under the cabinet.

In one embodiment, connector 230 includes a blind-mate drawer style connector from AMP with up to 30 contacts (AMP part number 213973-1). The plug side of connector 230 floats and has alignment guides. Connector 230 is mounted to the cabinet side of the connection since that is the most fixed side. One technique is to bury the connector into the latching mechanism. For example, cavity 712 can house the plug side of the connector.

Figure 8:
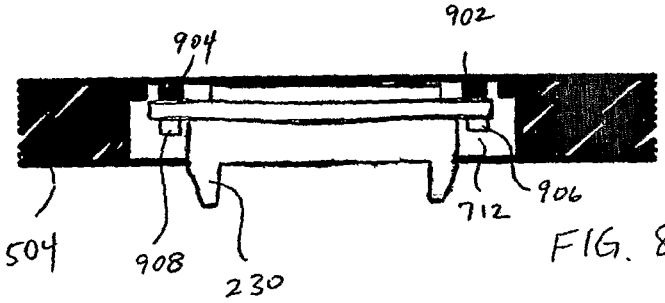
FIG. 8 shows a top, cross-section view of a mounting cavity of the latching mechanism of FIG. 7.

FIG. 8 shows a top, cross-section view of the mounting cavity 712 of latch mechanism 504. Two mounting holes 902 and 904 in the cavity are threaded for shoulder screws 906 and 908 that allow connector 230 to float in the cavity. In one embodiment, springs can be mounted on shoulder screws 906, 908 on either side of connector 230 to further allow the connector to move in an up-down or left-right or diagonal manner. This allows substantial misalignment between the base and the gaming machine and allows for tolerance to connect the electrical connection together. For example, the spring-loaded, float-mounted connector 230 adapts to the misalignment and can move up/down, left/right, or diagonally, as needed. Moreover, in one embodiment this can be a blind-mate connection system and the user does not manually manipulate the interconnection. Accordingly the system automatically adjusts as necessary.

To electrically and mechanically connect the chair to the device, the base is slid towards the device and guided as discussed above. The base is then latched to the device using one of the techniques described above or another latching system. Then the electrical connection is made from the connector on the base to the connector on the machine.

The latching mechanism provides a secure retention technique of the base and connector, while providing a stress-free electrical connection. This is important if somebody lifts the chair for example. In other words, the mechanical coupling holds the units together tightly enough that twisting one or the other does not effect the electrical connection. Also, the floating connection allows for mounting the base on either hard floors or carpeting.

To remove the base, for example, for maintenance reasons, the electrical connection is first decoupled, then the sled is unlatched and the base is slid away from the device.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A system comprising:

a chair having an electrical connector and a first audio output mechanism for generating an audio output in response to a first electrical signal transmitted by a USB streaming audio circuit board and received through the electrical connector;

a gaming machine having a floating electrical connector removably coupleable to the chair electrical connector and a second audio output mechanism for generating an audio output in response to a second electrical signal transmitted by the USB streaming audio circuit board, the USB streaming audio circuit board disposed within the gaming machine and operably coupled to a gaming CPU, the gaming CPU configured to determine if the chair is properly electrically coupled to the gaming machine;

wherein if the gaining CPU detects that the chair is not properly electrically coupled to the gaming machine, the gaming CPU performs one or more adjustments to the gaming machine including mixing the audio output of the gaming machine through the second audio output mechanism in a manner to compensate for the missing chair audio output through the first audio output mechanism.

2. The system of claim 1, wherein the chair includes a chair coupled to a base, and wherein the chair electrical connector is at a front section of the base.

3. The system of claim 1, including a speaker mounted to the chair and coupled to the chair electrical connector.

4. The system of claim 1, including a mechanical latching mechanism on the gaming machine to mechanically latch the chair to the gaming machine.

5. The system of claim 1, wherein the chair includes a chair mounted to a base and a base connector mounted to the base, wherein the chair electrical connector is coupled to the base connector.

6. The system of claim 1, wherein the floating electrical connector on the gaming machine includes a blind-mate drawer connector.

7. The system of claim 1 , wherein the gaming CPU is configured to further place the gaming machine into a tilt condition state if the gaming CPU detects that the chair is not properly electrically coupled to the gaming machine.

8. The system of claim 1, wherein the floating electrical connector on the gaming machine is a plug and the electrical connector on the chair is a receptacle.

9. The system of claim 1, further comprising a ground wire extending from a microcontroller of the USB streaming audio circuit board to the chair electrical connector, the ground wire looped through the chair electrical connector and returned to the microcontroller, wherein the gaming CPU is configured to query the USB streaming audio circuit board for a connection status.

10. An apparatus comprising:

a chair having an electrical connector and a first audio output mechanism for generating an audio output in response to a first electrical signal transmitted by USB streaming audio circuit board;

a retention assembly mountable to a gaming machine, the retention assembly including a connector opening, the gaming machine having a second audio output mechanism for generating an audio output in response to a second electrical signal transmitted by the USB streaming audio circuit board; and an electrical connector mounted to the retention assembly and accessible through the connector opening;

wherein the USB streaming audio circuit board is disposed within the gaming machine and operably coupled to a gaming CPU, the gaming CPU operably coupled to the electrical connecter and configured to detect if a corresponding external connector is properly electrically connected to the electrical connector, and wherein if the gaming CPU detects that the external connector is not properly electrically coupled to the gaming machine, the gaming CPU performs one or more adjustments to the gaming machine selected from the group consisting of placing the gaming machine into a tilt condition state and mixing the audio output of the gaming machine through the second audio output mechanism in a manner to compensate for missing external audio output through the first audio output mechanism of the chair.

11. The apparatus of claim 10, wherein the retention assembly includes a plate for mounting to the gaming machine, the plate including a plate connector opening, and a latching mechanism coupled to the plate and having a latching mechanism connector opening aligned with the plate connector opening.

12. The apparatus of claim 11, wherein the latching mechanism includes one or more alignment pins to guide a base of a chair when the base is mounted to a chair latching bracket.

13. The apparatus of claim 11, wherein the latching mechanism includes a spring-loaded door latch to engage a corresponding cavity on a base of a chair.

14. The apparatus of claim 10, wherein the connector is a plug connector.

15. The apparatus of claim 10, wherein the electrical connector is mounted to the retention assembly with shoulder screws to allow for a floating connection.

16. The apparatus of claim 10, wherein the gaming CPU is configured to place the gaming machine into the tilt condition state if the gaming CPU detects that a chair is not properly electrically coupled to the gaming machine.

17. The apparatus of claim 10, wherein the gaming CPU mixes the audio output of the gaming machine in the manner to compensate for missing external audio output if the gaming CPU detects that a chair is not properly electrically coupled to the gaming machine.

18. An apparatus comprising:

a chair having a first speaker for generating an audio output in response to a first electrical signal transmitted by a USB streaming audio circuit board;

a gaming machine having a second speaker for generating an audio output in response to a second electrical signal transmitted by the USB streaming audio circuit board;

a base, wherein the chair is mounted to the base;

an electrical connection running from the first speaker through the base and towards a front of the base; and a connector coupled to the electrical connection, the connector adapted to be detachably connected to a mating floating connector on the gaming machine, wherein the USB streaming audio circuit board is disposed within the gaming machine and operably coupled to a gaming CPU, the gaming CPU configured to determine if the chair is properly electrically coupled to the gaming machine, and wherein if the gaming CPU detects that the chair is not properly electrically coupled to the gaming machine, the gaming CPU performs one or more adjustments to the gaming machine selected from the group consisting of placing the gaming machine into a tilt condition state and mixing the audio output of the gaming machine through the second speaker in a manner to compensate for the missing chair audio output through the first speaker.

19. The apparatus of claim 18, wherein the electrical connection includes base connection mounted to the base.

20. The apparatus of claim 18, wherein the connector on the base includes a receptacle connector.

21. The apparatus of claim 18, including a shroud movably coupled to the base and covering the connector on the base.

22. The system of claim 18, wherein the gaming CPU is configured to mix the audio output of the gaming machine in the manner to compensate for the missing chair audio output if the gaming CPU detects that the chair is not properly electrically coupled to the gaming machine.

23. A method of coupling a chair base to a gaming device, comprising:

in response to movement of the chair base to an engagement position with the gaming device, mechanically latching the chair base to the gaining device, and electrically coupling the chair base to the gaming device via a floating connector on the gaming device;

providing a first electrical signal from a USB streaming audio circuit board to a chair speaker for generating chair audio output;

providing a second electrical signal from the USB streaming audio circuit board to a gaming device speaker for generating gaming device audio output;

using a gaming CPU to determine if the chair base is properly electrically connected to the gaming device, the gaming CPU operably coupled to the USB streaming audio circuit board; and if the chair base is not properly electrically connected to the gaming device, causing the gaming CPU to perform one or more adjustments to the gaming device including one or both of placing the gaming device into a tilt condition state or mixing the audio output of the gaming device through the gaming device speaker to compensate for missing chair audio output through the chair speaker.

24. The method of claim 23, wherein electrically coupling includes electrically coupling the chair speaker to the gaming device.

25. The method of claim 23, wherein electrically coupling includes coupling a receptacle connector on the chair base to a plug connector on the gaming device.

26. The method of claim 23, wherein if the chair base is not properly electrically connected to the gaming device, the gaming device goes into the tilt condition state.

27. The method of claim 23, wherein if the chair base is not properly electrically connected to the gaming device, the gaming CPU of the gaming device adjusts the audio output of the gaining device to compensate for missing chair audio output.

28. A system comprising:

a chair having an electrical connector and a first audio output mechanism for generating an audio output in response to a first electrical signal transmitted by a USB streaming audio circuit board and received through the electrical connector; and a gaming machine having a mating electrical connector and a second audio output mechanism for generating an audio output in response to a second electrical signal transmitted by the USB streaming audio circuit board, which is disposed within the gaming machine and operably coupled to a gaming CPU, the chair electrical connector being removably coupleable to the gaming machine electrical connector, wherein the gaming CPU is configured to determine if the connector on the base is properly electrically connected to the mating connector on the gaming machine, wherein if the gaining CPU detects that the chair is not properly electrically connected to the gaming machine, the gaming CPU is configured to perform one or more adjustments to the gaming machine selected from the group consisting of placing the gaming machine into a tilt condition state and mixing the audio output of the gaming machine through the second audio output mechanism in a manner to compensate for the missing chair audio output through the first audio output mechanism.

29. The system of claim 28, wherein the chair includes a speaker coupled to the electrical connector of the chair.

30. The system of claim 28, the gaming machine electrical connector includes a floating electrical connector.

31. The system of claim 28 wherein the gaming machine goes into the tilt condition state if the gaming CPU detects that the chair is not properly electrically coupled to the gaming machine

32. The system of claim 28, wherein the gaming CPU mixes the audio output of the gaming machine in the manner to compensate for the missing chair audio output if the gaming CPU detects that the chair is not properly electrically coupled to the gaming machine.

* * * * *

UNITED STATES PATENT AND TRADEMARK OFFICE

CERTIFICATE OF CORRECTION

PATENT NO. : 8,454,087 B2
APPLICATION NO. : 11/569687
DATED : June 4, 2013
INVENTOR(S) : Stephen A. Canterbury It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 729 days.

Signed and Sealed this
Eighth Day of September, 2015

Michelle K. Lee

Michelle K. Lee
*Director of the United States Patent and Trademark Office*